US009874391B2

(12) United States Patent
Jung

(10) Patent No.: US 9,874,391 B2
(45) Date of Patent: Jan. 23, 2018

(54) REFRIGERATOR

(71) Applicant: LG ELECTRONICS INC., Seoul (KR)

(72) Inventor: Jaehun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/397,347

(22) Filed: Jan. 3, 2017

(65) Prior Publication Data

US 2017/0191735 A1 Jul. 6, 2017

(30) Foreign Application Priority Data

Jan. 4, 2016 (KR) ..... 10-2016-0000641
Jun. 2, 2016 (KR) ..... 10-2016-0068671

(51) Int. Cl.

| | |
|---|---|
| ***F25D 23/02*** | (2006.01) |
| ***F25D 11/00*** | (2006.01) |
| ***F25D 23/06*** | (2006.01) |
| ***E05F 5/06*** | (2006.01) |

(Continued)

(52) U.S. Cl.

CPC ..... *F25D 23/025* (2013.01); *E05C 5/00* (2013.01); *E05C 7/04* (2013.01); *E05F 5/06* (2013.01); *F25D 11/00* (2013.01); *F25D 23/028* (2013.01); *F25D 23/066* (2013.01); *E05C 2005/005* (2013.01); *E05Y 2900/31* (2013.01); *F25D 2323/021* (2013.01)

(58) Field of Classification Search

CPC ..... F25D 23/02; F25D 23/025; F25D 23/028; F25D 23/066; F25D 23/087; F25D 11/00; F25D 25/02; F25D 25/021; F25D 25/022; E05C 5/00; E05C 7/04; E05F 5/06

USPC ..... 312/401, 405, 405.1, 321.5, 324, 326, 312/329; 62/440, 441; 49/478.1, 366, 49/367, 368

See application file for complete search history.

(56) References Cited

U.S. PATENT DOCUMENTS

2005/0046319 A1 3/2005 Chekal et al.
2007/0138925 A1* 6/2007 Fu ..... F25D 23/069 312/401

(Continued)

FOREIGN PATENT DOCUMENTS

KR 10-2012-0048426 5/2012
KR 10-2013-0105065 9/2013

(Continued)

OTHER PUBLICATIONS

International Search Report in International Application No. PCT/KR2016/012920, dated Feb. 13, 2017, 11 pages.

*Primary Examiner* — James O Hansen
(74) *Attorney, Agent, or Firm* — Fish & Richardson P.C.

(57) ABSTRACT

Disclosed is a refrigerator including a cabinet having a storage compartment, an inner case defining an external appearance of the storage compartment, a first door rotatably installed to the cabinet for opening or closing one side of the storage compartment, a second door rotatably installed to the cabinet for opening or closing a remaining side of the storage compartment, a pillar provided on the first door, the pillar being rotated so as to come into contact with the second door and having a pillar protrusion protruding from an upper side thereof, and a pillar rotation unit provided on a ceiling of the inner case for rotating the pillar.

18 Claims, 22 Drawing Sheets

(51) Int. Cl.
*E05C 5/00* (2006.01)
*E05C 7/04* (2006.01)

(56) References Cited

U.S. PATENT DOCUMENTS

| | | | | |
|---|---|---|---|---|
| 2012/0073321 | A1* | 3/2012 | Davis | F25D 23/028 62/449 |
| 2012/0137722 | A1* | 6/2012 | Kim | F25D 23/028 62/440 |
| 2013/0241385 | A1* | 9/2013 | Lee | F25D 23/028 312/404 |
| 2014/0268648 | A1* | 9/2014 | Gomes | F25D 27/005 362/94 |
| 2014/0375198 | A1* | 12/2014 | Jeon | F25D 23/028 312/404 |
| 2016/0146530 | A1* | 5/2016 | Jung | E05F 15/611 312/405.1 |

FOREIGN PATENT DOCUMENTS

| | | |
|---|---|---|
| KR | 10-2014-0046207 | 4/2014 |
| KR | 10-2015-0082065 | 7/2015 |

* cited by examiner (a)

(b)

(a)

(b)

(a)

(b)

(a)

(b)

REFRIGERATOR

CROSS-REFERENCE TO RELATED APPLICATION

This application claims the benefit of Korean Patent Application No. 10-2016-0000641, filed on Jan. 4, 2016 and No. 10-2016-0068671, filed on Jun. 2, 2016, which are each hereby incorporated by reference as if fully set forth herein.

TECHNICAL FIELD

The present invention relates to a refrigerator and, more particularly, to a refrigerator having improved convenience of use, the refrigerator being a dual door type refrigerator in which two doors are used to open a single storage compartment.

BACKGROUND

Generally, a refrigerator is an apparatus that may keep food fresh for a certain duration by cooling a storage compartment (e.g. a freezing compartment or a refrigerating compartment) while repeating a refrigeration cycle.

The refrigerator includes a compressor, which compresses refrigerant, circulating through a refrigeration cycle, into high-temperature and high-pressure refrigerant. The refrigerant, compressed in the compressor, cools air while passing through a heat exchanger, and the cooled air is supplied into the freezing compartment or the refrigerating compartment.

The refrigerator has a configuration in which the freezing compartment is at the upper side and the refrigerating compartment is at the lower side. A side-by-side type refrigerator may be configured such that the freezing compartment and the refrigerating compartment are arranged side by side on the left and right sides, respectively.

In addition, there is another type of refrigerator in which a single storage compartment, provided at the upper side or the lower side, may be opened by two doors, which are arranged side by side.

In the case where two doors are arranged side by side to open or close a single storage compartment, a pillar is installed on one of the two doors. The pillar is provided at any one of the two doors, and functions to increase the sealing efficiency of the storage compartment by coming into contact with the two doors when the two doors seal the storage compartment.

In the related art, in order to rotate the pillar, an inner case of the refrigerator is generally provided with a structure including a guide groove, which has a fixed shape and guides the rotation of the pillar.

According to this structure, in the state in which the door provided with the pillar seals the storage compartment, the pillar may block the path along which a drawer installed in the refrigerator moves because the pillar is moved away and unfolded from the corresponding door. Therefore, in the case where the refrigerator includes two drawers arranged parallel to each other, the two drawers must have different widths.

In addition, in consideration of the fact that the pillar is in the unfolded state, in the case where a basket is installed on the door so as to be rotated together with the door, the basket requires a gently curved corner portion so as not to come into contact with the unfolded pillar, which may result in a reduction in the storage capacity of the basket.

SUMMARY

Accordingly, the present invention is directed to a refrigerator that substantially obviates one or more problems due to limitations and disadvantages of the related art.

An object of the present invention is to provide a refrigerator having improved convenience of use, the refrigerator being a dual door type refrigerator in which two doors are used to open a single storage compartment.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, a refrigerator includes a cabinet having a storage compartment, an inner case defining an external appearance of the storage compartment, a first door rotatably installed to the cabinet for opening or closing one side of the storage compartment, a second door rotatably installed to the cabinet for opening or closing a remaining side of the storage compartment, a pillar provided on the first door so as to come into contact with the second door, the pillar having a pillar protrusion protruding from an upper side thereof, and a pillar rotation unit provided on a ceiling of the inner case for rotating the pillar, wherein the pillar rotation unit includes a rotating member having a guide recess, into which the pillar protrusion is inserted, a protruding piece for rotating the rotating member by coming into contact with the second door, and an elevating member for vertically moving the protruding piece, wherein the protruding piece includes a first magnet, and wherein the second door includes a second magnet for magnetically attracting the first magnet.

The first magnet may be vertically moved by the elevating member. As such, even if the second door droops, sufficient contact area between the second door and the protruding piece may be achieved.

When the first magnet is installed at a higher position than the second magnet, the extent to which the first magnet is exposed to a user may be reduced.

The first magnet may be moved downward toward the second magnet when the second magnet approaches the first magnet. When the second magnet approaches the first magnet, the first magnet may be moved so that a center of the first magnet in a height direction is located at the same height as a center of the second magnet in the height direction. As such, push force of the second door may be stably transferred to the protruding piece.

Because the first magnet may have a length in a height direction that is equal to or less than a height of the second magnet in the height direction, the first magnet may not deviate from a region in which the second magnet is located. Accordingly, it is possible to prevent the first magnet from being unnecessarily moved downward, thereby preventing unexpected interference with the second door.

The pillar rotation unit may further include a housing, to which the rotating member is rotatably coupled, and the elevating member may be coupled to the housing so as to be movable in a longitudinal direction thereof. The elevating member is movable not only in a vertical direction, but also in a longitudinal direction.

The elevating member may include a guide coupled to two bars provided in the housing so that a longitudinal movement thereof is guided, an elastic member accommodated in the guide, and a guide pin for performing vertical movement under guidance of the elastic member, and the guide pin may be coupled to the protruding piece so as to be vertically moved together with the protruding piece.

The guide may be provided with a first accommodating recess, which has a square shape, and the protruding piece may be provided with an accommodating protrusion, which has a square shape and is inserted into the first accommodating recess. The first accommodating recess and the accommodating protrusion may have a gap between facing sides thereof so that the protruding piece is rotatable at a predetermined angle relative to the guide. In the present invention, the operation may be implemented by the magnetic force between two magnets, i.e. the first magnet and the second magnet. When the area of facing surfaces of the two magnets is increased, greater magnetic interference may occur even when the magnetic force is consistent. Accordingly, even if the magnets having the same magnetic force is used, increasing the area of facing surfaces thereof may ensure the efficient use of the magnets.

The angular points of the accommodating protrusion may be rounded. As such, despite frequent rotation of the protruding piece, the rotation angle of the protruding piece at the initial stage and the rotation angle of the protruding piece after a certain time has passed may be maintained so as to be the same as each other or to be similar to each other.

The accommodating protrusion may have a second accommodating recess formed in a center thereof so that the guide pin is accommodated in and coupled to the second accommodating recess. The guide pin may be coupled to the second accommodating recess without a gap. As such, the protruding piece may stably achieve sufficient coupling with the elevating member.

The guide may have a stepped holding portion. As such, one side of the elastic member may be supported by the guide pin, and the other side of the elastic member may be supported by the stepped holding portion. Thereby, the elastic member may guide the vertical movement of the guide pin.

While the second door opens the storage compartment, the first magnet is moved forward to follow the second magnet. As such, while the second door opens the storage compartment, the rotating member may be rotated, thus causing the pillar to be rotated and folded. Accordingly, when the user pulls out a drawer located near the second door in the state in which the first door is closed and the second door is opened, the pillar does not interfere with the drawer.

When the second door opens the storage compartment, an upper surface of the protruding piece may be moved to be brought into contact with the inner case. When the second door seals the storage compartment, the upper surface of the protruding piece may be spaced apart from the inner case.

In accordance with another aspect of the present invention, a refrigerator includes a cabinet having a storage compartment, an inner case defining an external appearance of the storage compartment, a first door rotatably installed to the cabinet for opening or closing one side of the storage compartment, a second door rotatably installed to the cabinet for opening or closing a remaining side of the storage compartment, a pillar provided on the first door, the pillar being rotated so as to come into contact with the second door and having a pillar protrusion protruding from an upper side thereof, and a pillar rotation unit provided on a ceiling of the inner case for rotating the pillar, wherein the pillar rotation unit includes a rotating member having a guide recess, into which the pillar protrusion is inserted, and a protruding piece for rotating the rotating member by being brought into contact with the second door, wherein the protruding piece includes a first magnet, and wherein the second door includes a second magnet for magnetically attracting the first magnet, and a moving member for vertically moving the second magnet. In the present invention, the second magnet may be moved upward so as to ensure sufficient contact area between the protruding piece and the second door.

When the second magnet approaches the first magnet, the second magnet may be moved upward toward the first magnet so that a center thereof in a height direction is located at the same height as a center of the first magnet in the height direction. Accordingly, even if the sizes of the first magnet and the protruding piece are reduced, the contact area between the second door and the protruding piece may be increased, which may allow the rotation force of the second door to be uniformly transferred to the protruding piece.

The second magnet may have a length in a height direction that is equal to or less than a height of the first magnet in the height direction. As such, the second magnet and a case enclosing the second magnet do not come into contact with the ceiling of the inner case even if the second magnet is moved upward. Accordingly, when the second door is rotated, no friction may not be generated between the second magnet, the case, and the ceiling, which may prevent the user from being inconvenienced when using the second door.

The protruding piece may have an upper surface located so as to come into contact with the ceiling of the inner case, and the moving member may include a case for enclosing the second magnet, and an elastic member for elastically supporting the case in a downward direction, and the case may do not come into contact with the ceiling of the inner case when the elastic member is in a maximally compressed state.

The elastic member may include a coil spring, and the maximally compressed state of the coil spring may correspond to a sum of vertical cross sections of the coil spring. When the present invention is applied to a product, the protruding piece may be manufactured so as not to be brought into contact with the ceiling of the inner case in consideration of the sum of the vertical cross sections of the coil spring.

The moving member may further include a guide protrusion protruding upward from the second door, and a cover placed at an upper side of the guide protrusion, and the case and the elastic member may be fitted around the guide protrusion. Because the structure of moving the second magnet is sealed by the cover, the related components may not be exposed to the user, which may prevent damage to the components due to the access of the user.

Meanwhile, the second magnet may be moved downward when the second door opens the storage compartment, and may be moved upward when the second door seals the storage compartment. As such, the consistent contact area between the second door and the protruding piece may be maintained.

In the present invention, when the second door seals the storage compartment, the upper surface of the protruding piece may be spaced apart from the inner case, and the second magnet may be moved. Thereby, when the extent to which the second door droops is increased, the consistent contact area between the second door and the protruding piece may be maintained.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION

Figure 1:
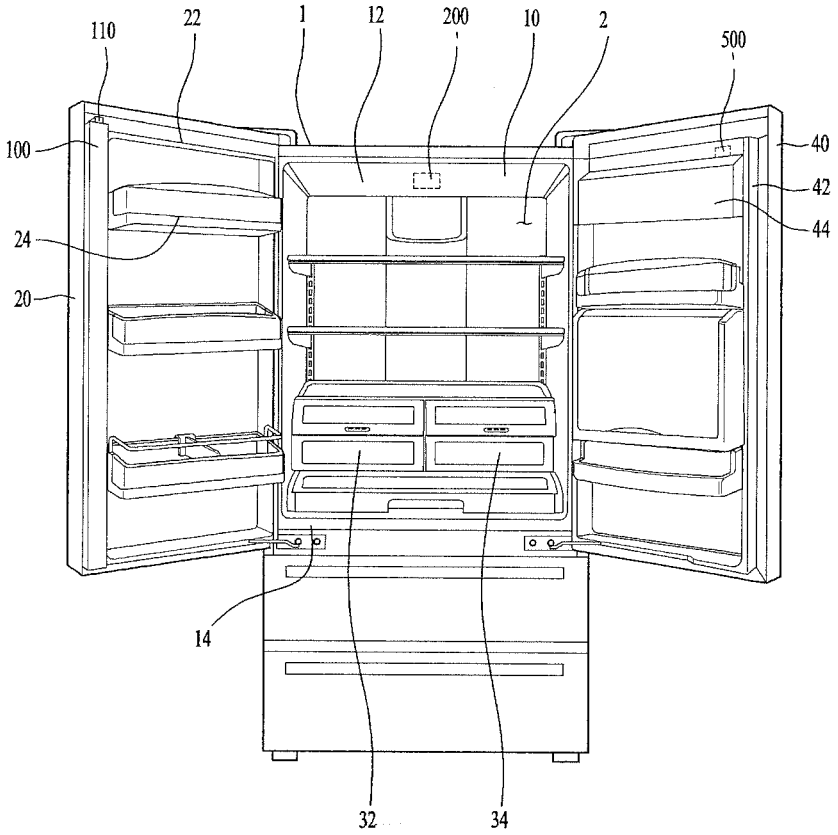
FIG. 1 is a front view illustrating a refrigerator according to an embodiment of the present invention.

Hereinafter, exemplary embodiments of the present invention will be described in detail with reference to the accompanying drawings in order to concretely realize the objects as set forth above.

In the drawings, the sizes or shapes of components may be exaggerated to emphasize more clearly the explanation in the drawings and for convenience. In addition, the terms, which are specially defined in consideration of the configuration and operations of the present invention, may be replaced by other terms based on intensions of users and operators or customs. The meanings of these terms should be construed based on the whole content of this specification.

FIG. 1 is a front view illustrating a refrigerator according to an embodiment of the present invention.

Referring to FIG. 1, the refrigerator according to the embodiment includes a cabinet 1, which defines the external appearance of the refrigerator.

The cabinet 1 has a storage compartment 2 in which food may be stored.

The external appearance of the storage compartment 2 may be defined by an inner case 10, which is provided inside the cabinet 1. The inner case 10 may include a top wall 12 and a bottom wall 14, which form the inner surface of the storage compartment 2, and the front side of the storage compartment 2 may be open in order to allow a user to access the storage compartment 2 through the front side of the storage compartment 2. The top wall 12 defines the ceiling of the storage compartment 2.

The cabinet 1 is provided at the front side thereof with a first door 20, which is rotatably installed to the cabinet 1 so as to open or close one side of the storage compartment 2, and a second door 40, which is rotatably installed to the cabinet 1 so as to open or close the other side of the storage compartment 2. At this time, when the first door 20 and the second door 40 close the front side of the storage compartment 2, the entire storage compartment 2 may be sealed.

A pillar 100 may be rotatably installed to the first door 20 so as to come into contact with the second door 40. The pillar 100 may generally have a rectangular shape and may be coupled to the first door 20 so as to be rotated relative to the first door 20. At this time, the pillar 100 may be positioned such that the rotated angle thereof relative to the first door 20 varies based on, for example, the angle by which the first door 20 is rotated relative to the storage compartment 2, or whether the second door 40 opens or closes the storage compartment 2.

The pillar 100 is provided with a pillar protrusion 110, which protrudes from the upper side of the pillar 100. The pillar 100 has a shorter length than the distance between the top wall 12 and the bottom wall 14 of the inner case 10 so as not to come into contact with the top wall 12 and the bottom wall 14.

The first door 20 may include a door dike 22, which defines the rear appearance of the first door 20. In addition, the second door 40 may include a door dike 42, which defines the rear appearance of the second door 40.

Baskets 24 and 44 may be installed to the respective door dikes 22 and 42, and may be used to store various shapes of food therein. At this time, the basket 44, which is installed to the second door 40, which is not provided with the pillar 100, does not interfere with the pillar 100 when the second door 40 is rotated. Therefore, the basket 44 may have an angled corner. Accordingly, the basket 44 may store an increased amount of food compared to a basket having a rounded corner.

The storage compartment 2 may include a first drawer 32 located near the first door 20, and a second drawer 34 located near the second door 40. At this time, the first drawer 32 and the second drawer 34 may be disposed in the same horizontal plane. That is, the first drawer 32 and the second drawer 34 may be arranged on the left and right sides respectively at the same height within the storage compartment 2. The first drawer 32 and the second drawer 34 may be pulled outward independently of each other.

The first drawer 32 and the second drawer 34 may have the same width. That is, the first drawer 32 and the second drawer 34 may have the same storage capacity, and may be replaced with each other. Assuming that the first drawer 32 and the second drawer 34 have different widths, and thus different shapes, the first drawer 32 and the second drawer 34 need to be differently manufactured, which may inevitably increase manufacturing costs. On the other hand, assuming that the two drawers 32 and 34 have the same shape, manufacturing costs thereof may be advantageously reduced.

In the embodiment of the present invention, the function described above may be implemented because, when the second door 40 is opened and the second drawer 34 is pulled outward in the state in which the first door 20 seals the storage compartment 2, the pillar 100 is not located in the path along which the second drawer 34 is pulled outward. The reason why the pillar 100 is not located in the path will be described later with reference to other drawings.

Meanwhile, in the embodiment of the present invention, the first door 20 and the second door 40 may have the same width. Thus, the first door 20 and the second door 40 may share some of the production processes thereof, which may reduce the production costs of the doors 20 and 40. The reason for this will be described later with reference to other drawings.

A pillar rotation unit 200 may be provided on the ceiling 12 of the inner case 10, and may serve to rotate the pillar 100. The pillar rotation unit 200 may come into contact with the pillar protrusion 110, thereby rotating the pillar 100 according to the rotation angle thereof.

In the embodiment of the present invention, the first door 20, which opens or closes the left side of the single storage compartment 2, and the second door 40, which opens or closes the right side of the single storage compartment 2, are provided so that the left and right sides of the single storage compartment 2 may be opened or closed by the respective doors 20 and 40.

The lower end of the pillar 100 may not come into contact with the bottom wall 14 of the inner case 10, and the angle by which the pillar 100 is rotated may be adjusted via contact between the pillar protrusion 110 and the pillar rotation unit 200.

A second magnet 500 may be provided in the door dike 42 of the second door 40. The second magnet 500 may generate magnetic attraction with a first magnet, which will be described later.

Figure 2:
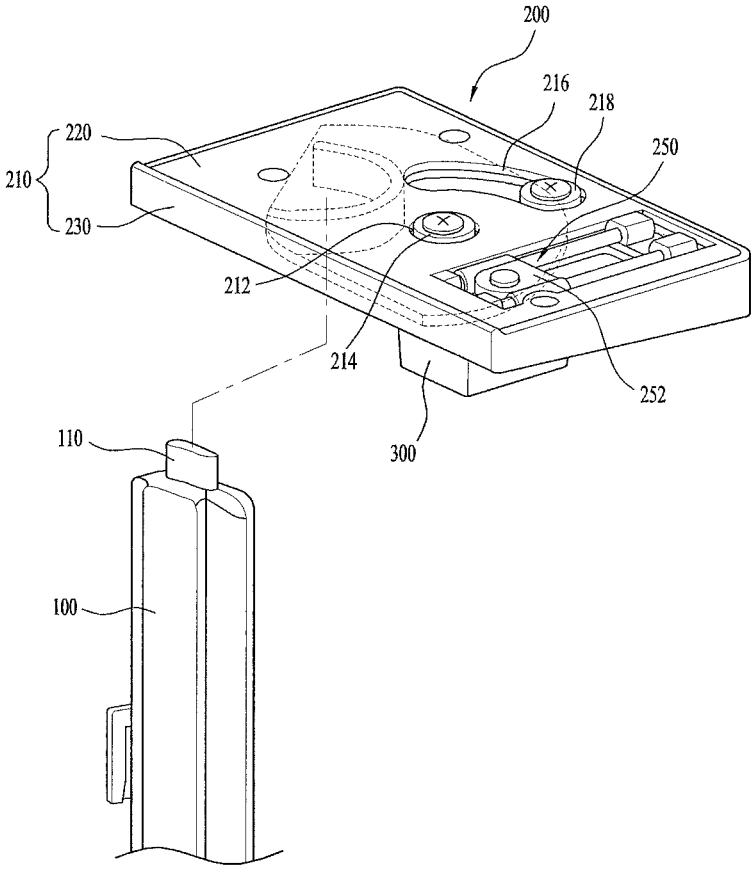
FIG. 2 is a view illustrating major parts according to the embodiment.
Figure 3:
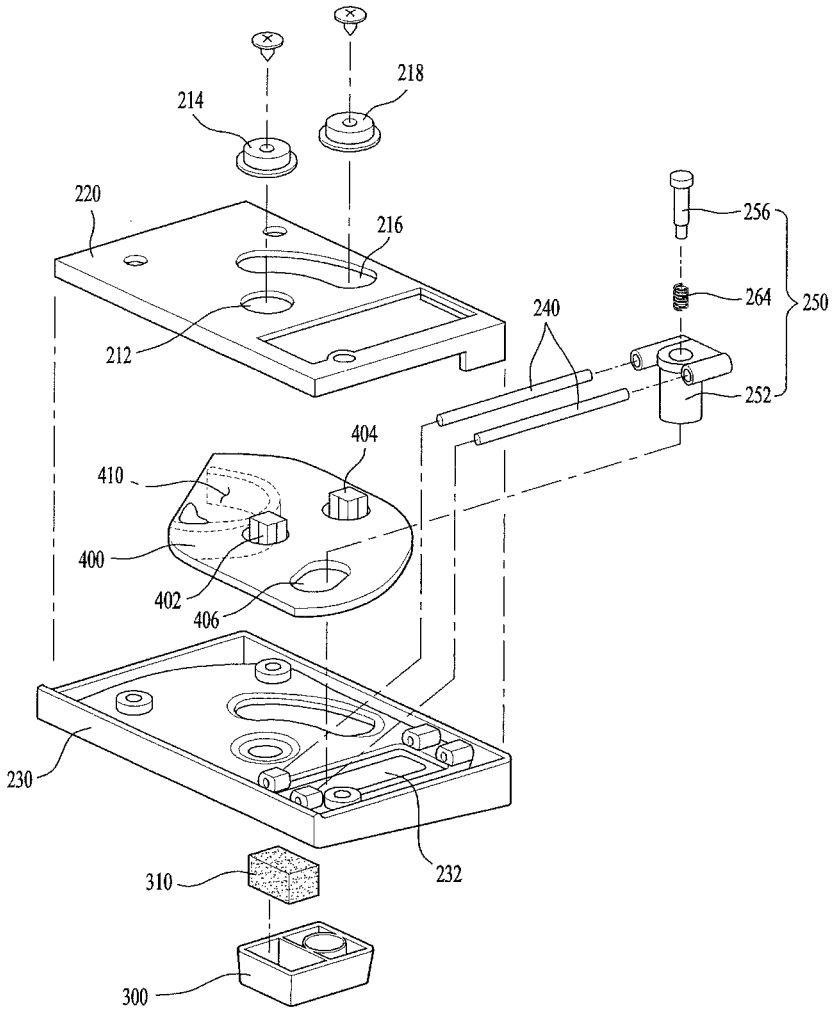
FIG. 3 is an exploded perspective view illustrating a pillar rotation unit according to the embodiment.

FIG. 2 is a view illustrating major parts according to the embodiment, and FIG. 3 is an exploded perspective view illustrating the pillar rotation unit according to the embodiment.

Referring to FIGS. 2 and 3, the pillar rotation unit 200 includes a housing 210, which defines the external appearance of the pillar rotation unit 200, a rotating member 400, which has a guide recess 410, into which the pillar protrusion 110 is inserted, a protruding piece 300, which rotates the rotating member 400 by being brought into contact with the second door 40, and an elevating member 250, which vertically moves the protruding piece 300.

The housing 210 may include an upper housing 220, which defines the external appearance of the upper part, and a lower housing 230, which defines the external appearance of the lower part. The rotating member 400 may be rotatably placed in the space between the upper housing 220 and the lower housing 230 so as to perform rotation as needed.

The upper housing 220 is provided with a first coupling hole 212, which forms the center of rotation of the rotating member 400, and the rotating member 400 is provided with a member 402, which penetrates the first coupling hole 212. The member 402 is located so as to penetrate the first coupling hole 212 in the state in which it has been coupled with a first coupling element 214. As such, the rotating member 400 may be rotated about the first coupling hole 212, which is the center of rotation, relative to the upper housing 220. At this time, the first coupling element 214, rather than the member 402, may be located so as to penetrate the first coupling hole 212. The first coupling hole 212 may have a circular shape in order to ensure the smooth rotation of the rotating member 400 without interference.

The upper housing 220 is provided with a second coupling hole 216, which guides the path along which the rotating member 400 is rotated, and the rotating member 400 is provided with a member 404, which penetrates the second coupling hole 216. The member 404 is located so as to penetrate the second coupling hole 216 in the state in which it has been coupled with a second coupling element 218.

The rotating member 400 is rotated about the first coupling hole 212 or the first coupling element 214, or about the member 404. The rotating member 400 may be rotated by the same angular range as an angular range within which the member 404 is moved in the second coupling hole 216.

The first coupling hole 212 has a circular shape, whereas the second coupling hole 216 has an elongated arc shape so as to extend around the first coupling hole 212 at a consistent radius. The path along which the rotating member 400 is rotated may be determined based on the arc shape of the second coupling hole 216.

The rotating member 400 may be provided with a through-hole 406 so that a portion of the elevating member 250 may penetrate the rotating member 400. The through-hole 406 may be larger than the cross section of the elevating member 250 so that the rotating member 400 and the elevating member 250 are loosely coupled to each other. At this time, the degree of loose coupling may be set to allow the elevating member 250 to move in the longitudinal direction thereof while the rotating member 400 is rotated.

The elevating member 250 is installed in the lower housing 230 so as to be longitudinally movable. Two bars 240 may be fitted into the lower housing 230 so as to penetrate the elevating member 250. As such, the two bars 240 may guide the path along which the elevating member 250 is longitudinally moved.

The elevating member 250 may include a guide 252, which is coupled to the two bars 240 provided in the lower housing 230, an elastic member 264, which is accommodated in the guide 252, and a guide pin 256, which is vertically moved under the guidance of the elastic member 264. The protruding piece 300 may be coupled to the guide pin 256 so as to be vertically moved together with the guide pin 256.

The protruding piece 300 may include a portion, which is coupled to the guide pin 256, and a portion in which a first magnet 310 is installed. The portion, to which the guide pin 256 is coupled, is located in front of the portion in which the first magnet 310 is installed.

With the structure described above, the rotating member 400 may be rotated relative to the housing 210, whereas the elevating member 250 may be longitudinally moved relative to the housing 210 depending on the rotation of the rotating member 400. For example, when the elevating member 250 is moved backward, the rotating member 400 may be rotated in the counterclockwise direction. On the other hand, when the elevating member 250 is moved forward, the rotating member 400 may be rotated in the clockwise direction.

Regardless of the longitudinal movement of the elevating member 250, the protruding piece 300 may be vertically moved depending on whether the elastic member 264 of the elevating member 250 is compressed.

The guide recess 410 may have a curvilinear shape in order to smoothly guide movement of the pillar protrusion 110 when the pillar protrusion 110 comes into contact with the inner surface of the guide recess 410. Because the pillar protrusion 110 is moved together with the pillar 100, the pillar 100 may be guided when the pillar protrusion 110 is guided by the guide recess 410, which enables adjustment in the angle by which the pillar 100 is rotated. Specifically, the pillar 100 may be changed to the folded state or the unfolded state thereof.

Figure 4:
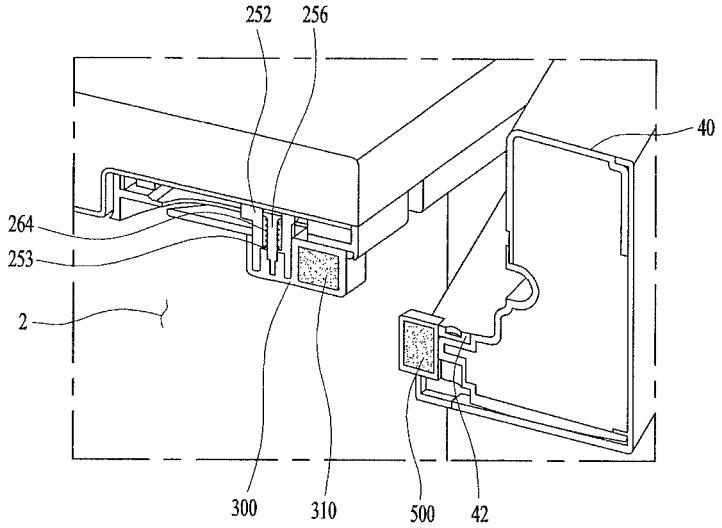
FIG. 4 is a view for explaining an operation of lowering a protruding piece according to the embodiment.
Figure 4:
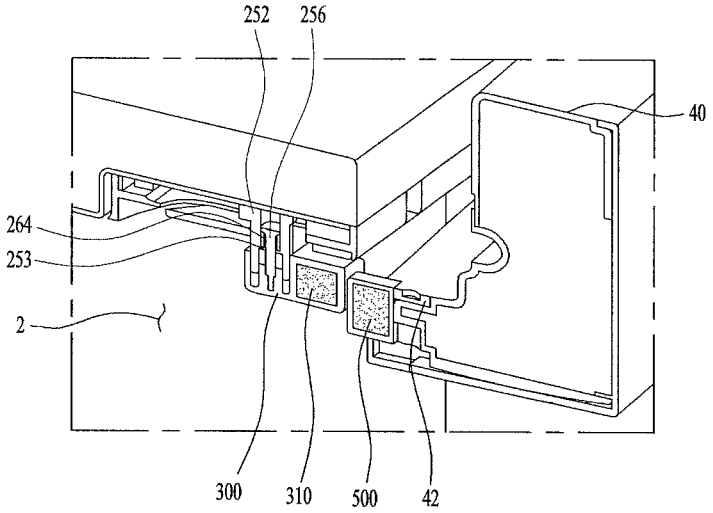

FIG. 4 is a view for explaining an operation of lowering the protruding piece according to the embodiment.

Referring to FIG. 4, the guide 252 has a stepped holding portion 253 formed therein. As such, one side of the elastic member 264 is supported by the guide pin 256, and the other side of the elastic member 264 is supported by the stepped holding portion 253. Thereby, the elastic member 264 may guide the vertical movement of the guide pin 256.

That is, the elastic member 264 may be located between the guide pin 256 and the stepped holding portion 253 so that the protruding piece 300 may be moved upward or downward when the elastic member 264 is compressed or tensioned.

The protruding piece 300 may include the first magnet 310, and the second door 40 may include the second magnet 500. The first magnet 310 and the second magnet 500 are affected by the magnetic force thereof, and have polarities for magnetic attraction therebetween. That is, when the distance between the first magnet 310 and the second magnet 500 is reduced, the first magnet 310 and the second magnet 500 may exert greater attraction force and thus approach each other.

As illustrated in FIG. 4(*a*), in the state in which the second door 40 opens the storage compartment 2, i.e. in which the second door 40 is rotated at a large angle relative to the cabinet 1, the first magnet 310 and the second magnet 500 are not particularly affected by the magnetic force thereof. Thus, because the first magnet 310 causes the elastic member 264 to maintain the original size thereof, the protruding piece 300 is not moved downward, and thus the upper surface of the protruding piece 300 is located so as to come into contact with the ceiling 12 of the inner case 10. That is, the protruding piece 300 remains in the upwardly moved state thereof.

As illustrated in FIG. 4(*b*), when the second door 40 approaches the storage compartment 2, the first magnet 310 and the second magnet 500 act to magnetically attract each other. The second magnet 500 is fixed in the second door 40 and thus cannot be moved. On the other hand, because the first magnet 310 is provided in the protruding piece 300, which may compress the elastic member 264, the protruding piece 300 is moved downward by the magnetic attraction between the first magnet 310 and the second magnet 500.

Accordingly, in the state illustrated in FIG. 4(*b*), the first magnet 310 and the second magnet 500 face each other, and thus the area at which the protruding piece 300 and the second door 40 come into contact with each other is increased. As such, the second door 400 may stably move the protruding piece 300 backward by coming into surface contact with the protruding piece 300.

When the second door 40 is rotated closer to the storage compartment 2 than the state illustrated in FIG. 4*b*, the first magnet 310 is moved downward so that the vertical center thereof is located at the same height as the vertical center of the second magnet 500. As the distance between the first magnet 310 and the second magnet 500 is reduced, magnetic interference between the first magnet 310 and the second magnet 500 is increased, whereby the two magnets 310 and 500 may be located at the same height via magnetic attraction therebetween.

Meanwhile, at the position at which the first magnet 310 and the second magnet 500 are not affected by each other, i.e. in the state illustrated in FIG. 4(*a*), the first magnet 310 is located higher than the second magnet 500. At this time, when the second magnet 500 approaches the first magnet 310, the first magnet 310 is moved down toward the second magnet 500. That is, when the second magnet 500 approaches the first magnet 310, the center of the first magnet 310 in the height direction is moved to the same height as the center of the second magnet 500 in the height direction. When the centers of the first magnet 310 and the second magnet 500 are located at the same height, the second door 40 may sufficiently come into surface contact with the protruding piece 300, whereby the rotating member 400 may be stably rotated by the second door 40.

Of course, when the second door 40 is rotated to increase the degree of opening of the storage compartment 2, the distance between the first magnet 310 and the second magnet 500 is increased, and the magnetic attraction, and consequently the magnetic interference between the first magnet 310 and the second magnet 500 is reduced. Accordingly, when the second magnet 500 no longer exerts the magnetic force required to cause the first magnet 310 to compress the elastic member 264, the elastic member 264 is returned to the original size thereof, thereby bringing the upper surface of the protruding piece 300 into contact with the ceiling 12.

Figure 5:
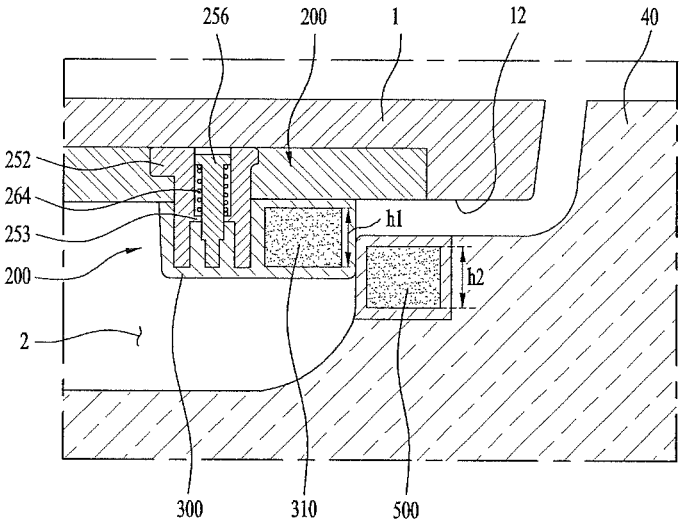
FIG. 5 is an auxiliary view for explaining an operation according to the embodiment.

FIG. 5 is an auxiliary view for explaining an operation according to the embodiment.

FIG. 5 illustrates the state in which the protruding piece 300 is not moved downward and the second door 40 is introduced into the storage compartment 2. The pillar rotation unit 200 according to the embodiment of the present invention is not operated as illustrated in FIG. 5, and thus the illustration is provided only for the purpose of explanation.

In the embodiment of the present invention, a length h1 of the first magnet 310 in the height direction may be equal to or less than a length h2 of the second magnet 500 in the height direction. Because the first magnet 310 protrudes from the ceiling 12 of the inner case 10 by the length h1, the greater length h1 may cause user inconvenience. Of course, although the protruding piece 300 causes almost no inconvenience when the user introduces or discharges storage items into or from the storage compartment 2 because it is located on the ceiling 12, the user may experience discomfort due to the shape of the protruding piece 300. Thus, the first magnet 310 having a smaller length h1 may be provided.

Accordingly, in the embodiment, the protruding piece 300 is designed to have a small vertical length calculated to ensure that the second door 40 may stably push the protruding piece 300.

In the case where the length h1 of the first magnet 310 is small, as illustrated in FIG. 5, sufficient surface contact between the protruding piece 300 and the second door 40 may not be achieved.

That is, in the state in which the protruding piece 300 is not moved downward, the protruding piece 300 and the first magnet 310 are located higher than the second magnet 500. Therefore, because the protruding piece 300 and the second door 40 cannot realize sufficient surface contact therebetween, when the second door 40 pushes the protruding piece 300, the force of the second door 40 may be locally transferred to a portion of the protruding piece 300, which may cause the protruding piece 300 to receive excessive load. In order to prevent this problem, in the embodiment, the protruding piece 300 may be moved downward so as to achieve sufficient surface contact with the second door 40 even if the vertical height of the protruding piece 300, i.e. the length h1 of the first magnet 310 in the height direction is small.

That is, in the embodiment, although the protruding piece 300 has a small vertical length, the protruding piece 300 is configured so as to be moved downward as needed, in order to increase the contact area between the protruding piece 300 and the second door 40.

Figure 6A:
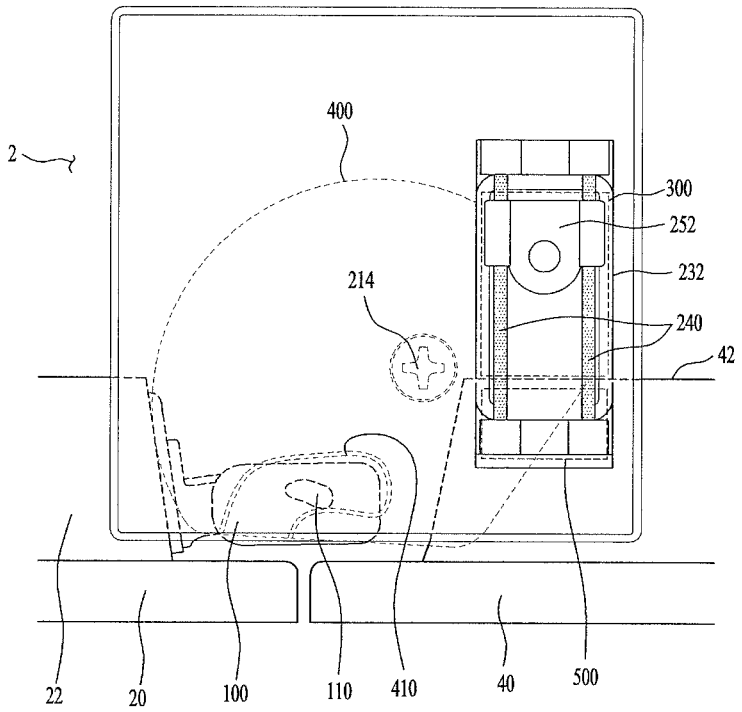
FIGS. 6A to 6C are views for explaining an operation in the state in which a second door seals a storage compartment while a first door opens the storage compartment.
Figure 6B:
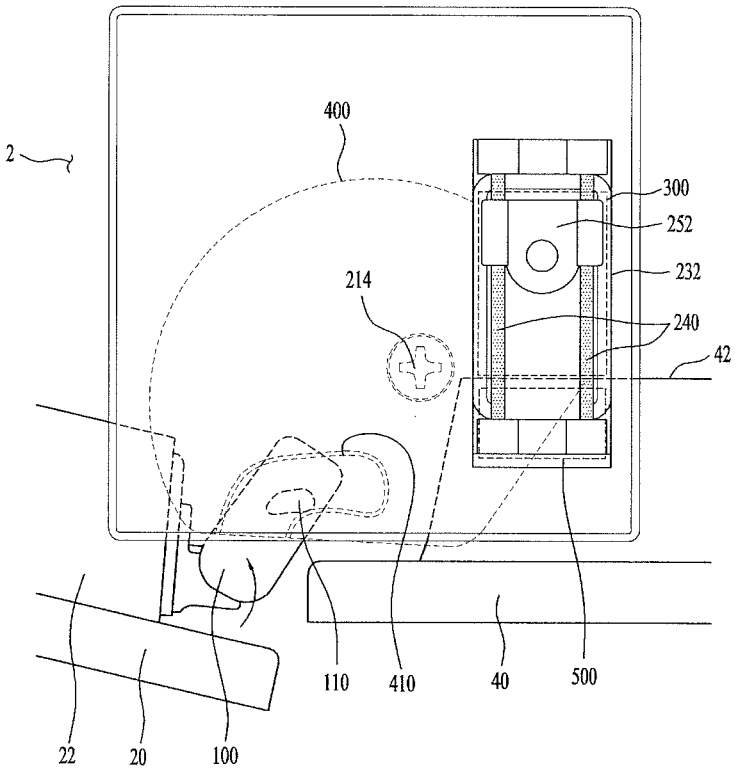
Figure 6C:
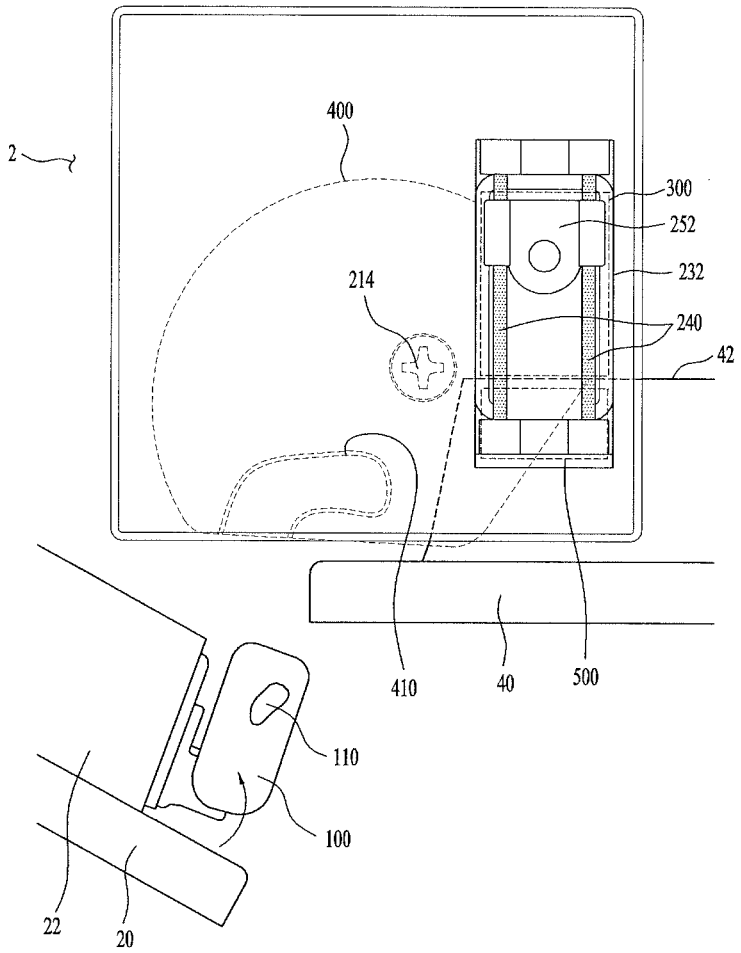

FIGS. 6A to 6C are views for explaining an operation in the state in which the second door seals the storage compartment while the first door opens the storage compartment.

FIG. 6A illustrates the state in which the first door and the second door seal the storage compartment, and FIGS. 6B and 6C illustrate the state in which the degree of opening of the storage compartment by the first door is sequentially increased.

In the state in which the second door 40 is stationary, whereby the storage compartment 2 is sealed, the protruding piece 300 remains in contact with the second door 40, and thus is introduced into the storage compartment 2 while coming into contact with the rear surface of the second door 40.

Because the protruding piece 300 is moved to the inside of the storage compartment 2, the rotating member 400 remains stationary.

As the user opens the first door 20, the pillar protrusion 110 is brought into contact with the guide recess 410, thereby causing the pillar 100 to be rotated. That is, the pillar 100 is in the unfolded state in FIG. 6A, but is changed to the folded state as the first door 20 is opened and the pillar protrusion 110 is moved along the guide recess 410.

Accordingly, the first door 20 may be opened in the state in which the pillar 100 is in the folded state.

An operation in the case where the user attempts to close the first door 20 in the state in which the second door 40 is closed may be performed in the sequence of FIG. 6C, FIG. 6B and FIG. 6A. Because the second door 40 fixes the protruding piece 300 at the same position in the closed state thereof, the rotating member 400 remains stationary, rather than being moved.

Figure 7A:
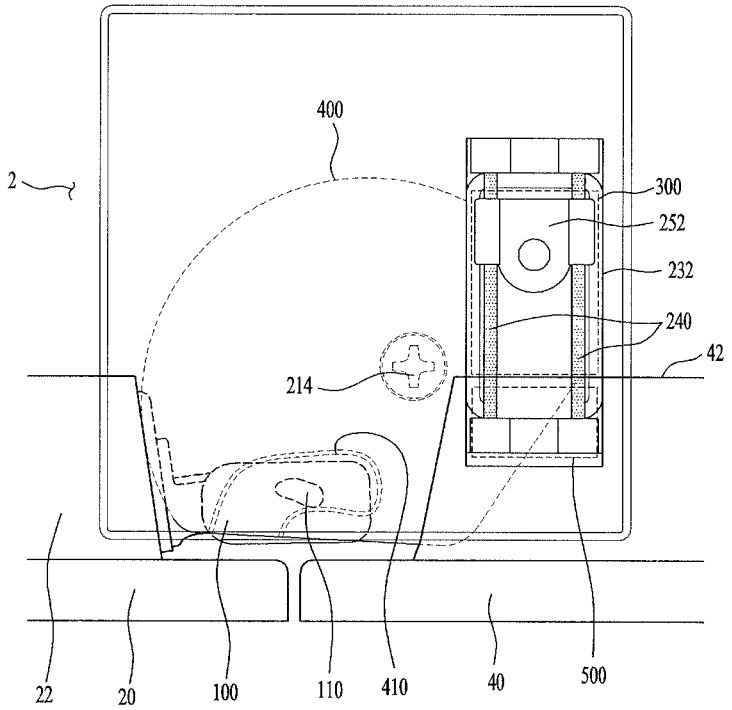
FIGS. 7A to 7C are views for explaining the sequence of an operation of opening the storage compartment by the second door in the state in which the first door seals the storage compartment.
Figure 7B:
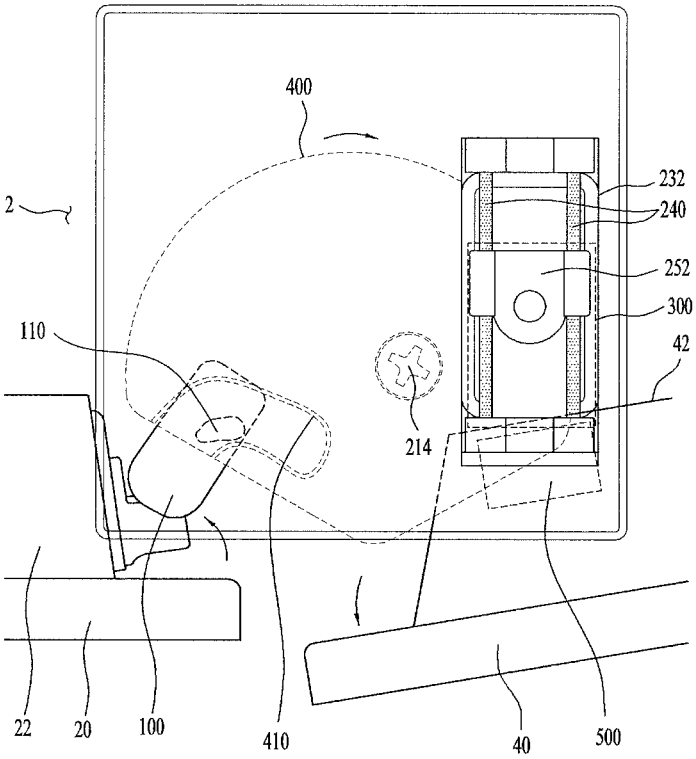
Figure 7C:
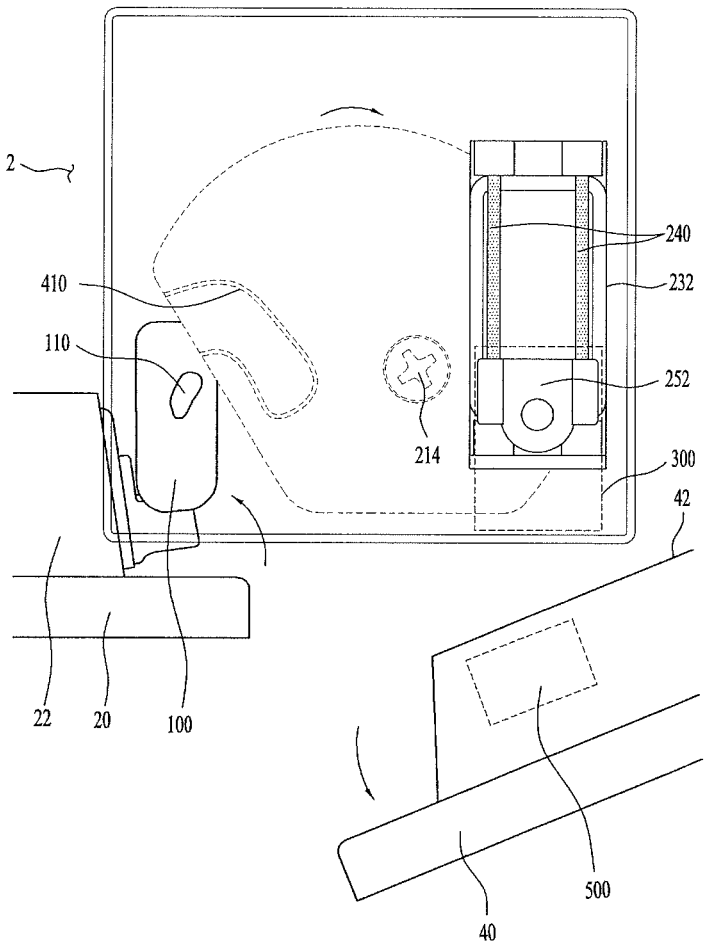

FIGS. 7A to 7C are views for explaining the sequence of an operation of opening the storage compartment by the second door in the state in which the first door seals the storage compartment.

FIG. 7A illustrates the state in which the first door and the second door seal the storage compartment, and FIGS. 7B and 7C illustrate the state in which only the second door is sequentially rotated to open the storage compartment.

When the user rotates the second door 40 in the state illustrated in FIG. 7A, the elevating member 250 is moved forward. In the state of FIG. 7A, because the protruding piece 300 and the second door 40 are in contact with each other, the distance between the first magnet 310 and the second magnet 500 is small. Therefore, owing to the magnetic attraction between the first magnet 310 and the second magnet 500, when the second magnet 500 is moved, the first magnet 310 may be moved to follow the second magnet 500.

As the second door 40 is opened as illustrated in FIG. 7B, the elevating member 250 is moved forward to follow the second door 40 by the magnetic attraction between the first magnet 310 and the second magnet 500.

Although the first door 20 and the pillar 100 are stationary, the rotating member 400 is rotated as the protruding piece 300 is moved, and simultaneously, the guide recess 410 is moved. As such, although the pillar protrusion 110 is stationary, the pillar protrusion 110 may be brought into contact with the moved guide recess 410, thereby causing the pillar 100 to be changed to the folded state thereof.

When the second door 40 is opened in the state in which the first door 20 is closed, the pillar 100 is changed to the folded state thereof, which may prevent the pillar 100 from interfering with the drawer, which is located near the second door 40 when the drawer is opened.

Because the pillar 100 is folded, the user experiences no interference when pulling the drawer located near the second door 40. In addition, because the pillar 100 is folded, the pillar 100 does not interfere with the basket installed on the second door 40 when the basket is pulled outward. Accordingly, the basket may be manufactured to have an angled corner, which may increase the storage space in the basket.

Meanwhile, an operation in the case where the user attempts to close the second door 40 in the state in which the first door 20 is closed may be performed in the sequence of FIG. 7C, FIG. 7B and FIG. 7A. Thus, after the second door 40 is closed, the pillar 100 may be unfolded, whereby the storage compartment 2 may be sealed by the first door 20, the pillar 100, and the second door 40.

Figure 8:
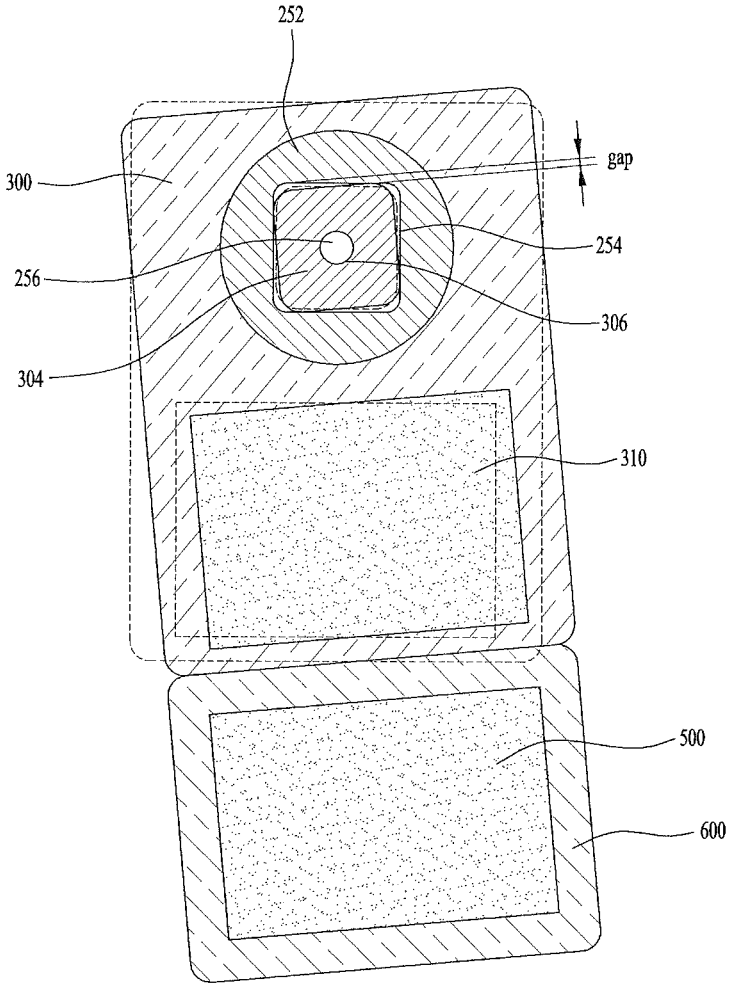
FIG. 8 is a sectional view illustrating the inside of the protruding piece.

FIG. 8 is a sectional view illustrating the inside of the protruding piece.

Referring to FIG. 8, the guide 252 may be provided with a first accommodating recess 254, which has a square shape, and the protruding piece 300 may be provided with an accommodating protrusion 304, which has a square shape and is configured to be inserted into the first accommodating recess 254.

The first accommodating recess 254 and the accommodating protrusion 304 may have a gap between facing surfaces thereof so that the protruding piece 300 may be rotated at a predetermined angle relative to the guide 252.

Because both the first accommodating recess 254 and the accommodating protrusion 304 generally have a square cross section and also have a gap between the respective facing sides thereof, the accommodating protrusion 304 may be rotated inside the accommodating recess 254.

At this time, although the maximum rotation angle may be approximately 5 degrees, it may be changed based on the path along which the second door 40 is rotated, i.e. the length of the second door 40 from the center of rotation of the second door 40.

The protruding piece 300 may be rotated at a predetermined angle, which may increase the range within which the protruding piece 300 and the second door 40 may come into surface contact with each other as the second door 40 is rotated. Thereby, the second door 40 may stably push the protruding piece 300.

The second magnet 500, installed in the second door 40, is moved along a circular path about the center of rotation of the second door 40. Therefore, the area at which the protruding piece 300 and the second magnet 500 overlap each other may be increased as the protruding piece 300 is rotated.

The angular points of the square accommodating protrusion 304 may be rounded. Because the protruding piece 300 is rotated when the second door 40 is rotated, the angular points of the accommodating protrusion 304 may be worn. Because the wearing of the angular points may cause variation in the rotation angle of the protruding piece 300, the protruding piece 300 may be subjected to chamfering so as to have a rounded shape.

The accommodating protrusion 304 may have a second accommodating recess 306 formed in the center thereof so that the guide pin 256 is accommodated in and coupled to the second accommodating recess 306. The guide pin 256 is coupled to the second accommodating recess 306 without a gap. Accordingly, the protruding piece 300 may be vertically moved when the guide pin 256 is vertically moved, regardless of the guide 252.

That is, the longitudinal movement of the protruding piece 300 may be guided by the guide 252, and the vertical movement of the protruding piece 300 may be guided by the guide pin 256.

In the embodiment, while the second door 40 closes the storage compartment 2, the first magnet 310 is moved forward toward the second magnet 500 in order to come into contact with the second magnet 500. Thus, no other element for moving the elevating member 250 in the longitudinal direction may be required, which may simplify the overall configuration.

Owing to the magnetic attraction between the first magnet 310 and the second magnet 500, the first magnet 310 is moved forward to follow the second magnet 500 while the second door 40 opens the storage compartment 2.

Meanwhile, once the second door 40 has opened the storage compartment 2, the upper surface of the protruding piece 300 is located such that it is in contact with the inner case 10. When the distance between the first magnet 310 and the second magnet 500 is increased so that the first magnet 310 and the second magnet 500 no longer magnetically attract each other, the second magnet 500 may no longer exert magnetic force required to cause the first magnet 310 to compress the elastic member 264. Thereby, because the elastic member 264 is returned to the original size thereof, the protruding piece 300 may be moved upward. Accordingly, the likelihood that the user perceives the protruding piece 300 may be reduced, and the user may access the storage compartment 2 without interference.

On the other hand, when the second door 40 seals the storage compartment 2, the upper surface of the protruding piece 300 is spaced apart from the inner case 10, and the protruding piece 300 is brought into surface contact with the second door 40, whereby the second door 40 may stably rotate the rotating member 400.

When a great amount of food is stored in the second door 40, or when the second door 40 is used for a long time, the phenomenon in which one side of the second door 40 droops may occur. Even in this case, in the embodiment, because the protruding piece 300 may be moved downward so as to be located at the same height as the height of the second magnet 500 while compressing the elastic member 264, the second door 40 may achieve sufficient contact area with the protruding piece 300. Accordingly, the second door 40 may stably transfer force to the protruding piece 300, and may rotate the rotating member 400 so that the pillar 100 is rotated at a desired angle so as to be folded or unfolded.

Figure 9:
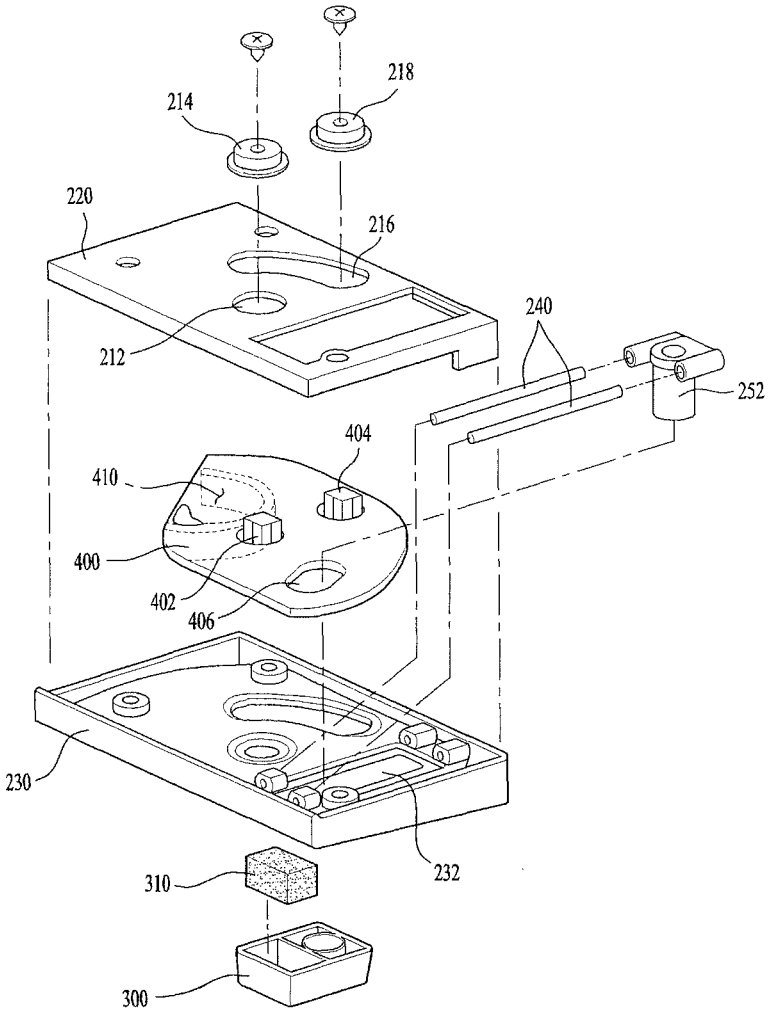
FIG. 9 is a view illustrating a pillar rotation unit according to another embodiment of the present invention.

FIG. 9 is a view illustrating the pillar rotation unit according to another embodiment of the present invention.

Unlike the above-described embodiment, in the present embodiment, the pillar rotation unit includes no elevating member, and thus the protruding piece cannot be moved in the vertical direction. On the other hand, the second magnet installed in the second door includes a moving member, which enables the vertical movement of the second magnet. That is, in the present embodiment, in order to match the heights of the first magnet and the second magnet, the second magnet, rather than the first magnet, is moved.

Because there is a huge overlap between the present embodiment and the above-described embodiment, a description of parts common to both is omitted, and the following description focuses only on different parts.

Referring to FIG. 9, in the present embodiment, the pillar rotation unit 200 includes the guide 252, which may be moved in the longitudinal direction, but includes no guide pin or elastic member, which may be moved in the vertical direction.

That is, the pillar rotation unit 200 includes the rotating member 400, which has the guide recess 410 into which the pillar protrusion 110 is inserted, and the protruding piece 300, which rotates the rotating member 400 by being brought into contact with the second door 40, and the protruding piece 300 includes the first magnet 310.

At this time, the pillar rotation unit 200 further includes the housings 220 and 230, to which the rotating member 400 is rotatably coupled. The protruding piece 300 is coupled to the housings 220 and 230 so as to be movable in the longitudinal direction.

The guide 252 is installed on the two bars 240 so as to be moved in the longitudinal direction.

Meanwhile, unlike the above-described embodiment, in the present embodiment, the protruding piece 300 may be directly coupled to the guide 252. In the present embodiment, because the protruding piece 300 is not moved in the vertical direction, the protruding piece 300 may be coupled to the guide 252 so as to be fixed thereto. As such, the protruding piece 300 is longitudinally movable together with the guide 252, but is not vertically movable relative to the guide 252.

At this time, the protruding piece 300 and the guide 252 may be coupled to each other using, for example, bolts. The bolts may correspond to the guide pin of the above-described embodiment. In the present embodiment, because no elastic member is provided, the protruding piece 300 is not vertically movable despite the fact that the protruding piece 300 and the guide 252 are coupled to each other.

Of course, in the same manner as the above-described embodiment, in the present embodiment, the protruding piece 300 may be rotated at a predetermined angle relative to the guide 252. The protruding piece 300 and the guide 252 have a square cross section, and are coupled to each other with a gap therebetween. As such, the protruding piece 300 may be rotated depending on the position of the second door 40, thereby being oriented to face the second door 40. The other configurations are the same as those in the above-described embodiment, and thus a detailed description thereto is omitted and is replaced with the description of the above-described embodiment.

Figure 10:
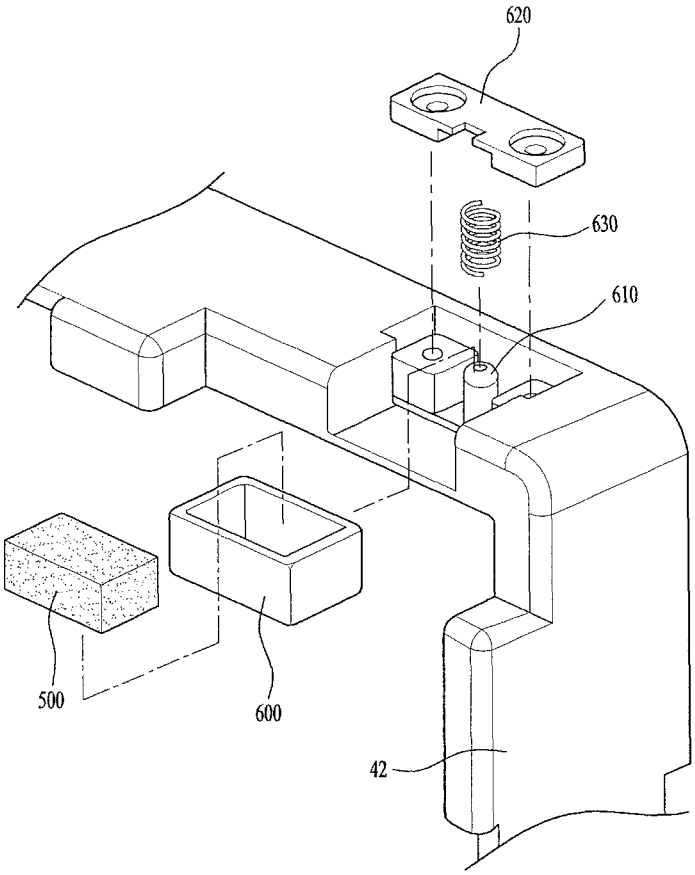
FIG. 10 is a view illustrating major parts according to the embodiment.
Figure 11:
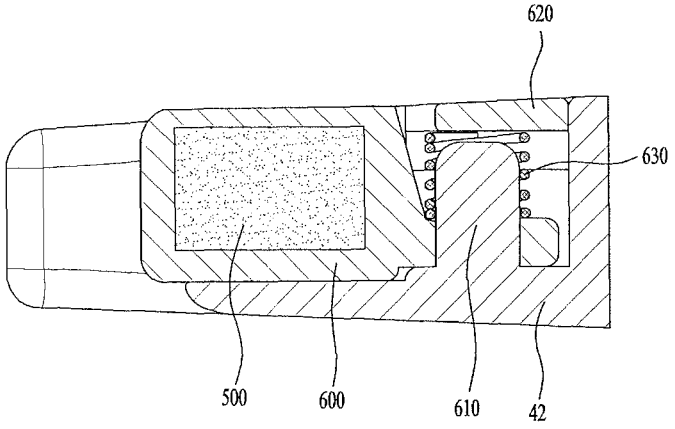
FIG. 11 is an exploded perspective view of FIG. 10.

FIG. 10 is a view illustrating major parts according to the present embodiment, and FIG. 11 is an exploded perspective view of FIG. 10.

FIGS. 10 and 11 illustrate the portion corresponding to a corner of the door dike 42 of the second door 40.

In the present embodiment, the position at which the second magnet 500 is installed is similar to that in the above-described embodiment. However, unlike the above-described embodiment, in the present embodiment, the moving member is provided to enable the vertical movement of the second magnet 500.

The second door 40 includes the second magnet 500, which is affected by the magnetic attraction of the first magnet 310, and the moving member, which vertically moves the second magnet 500.

The moving member includes a case 600, which encloses the second magnet 500, and an elastic member 630, which elastically supports the case 600 in a downward direction. The case 600 is moved upward when the elastic member 630, which pushes the upper side of the case 600 downward, is compressed, but is moved downward when the elastic member 630 is returned to the original size thereof.

The moving member further includes a guide protrusion 610, which protrudes upward from the second door 40, and a cover 620, which is placed at the upper side of the guide protrusion 610. The case 600 and the elastic member 630 are fitted around the guide protrusion 610.

The elastic member 630 is supported at the upper side thereof by the cover 620 and supported at the lower side thereof by the case 600, and the guide protrusion 610 is inserted into the center of the elastic member 630.

The elastic member 630 may include a coil spring that may be compressively deformed. The coil spring generally has a spirally wound hollow cylinder shape.

Figure 12:
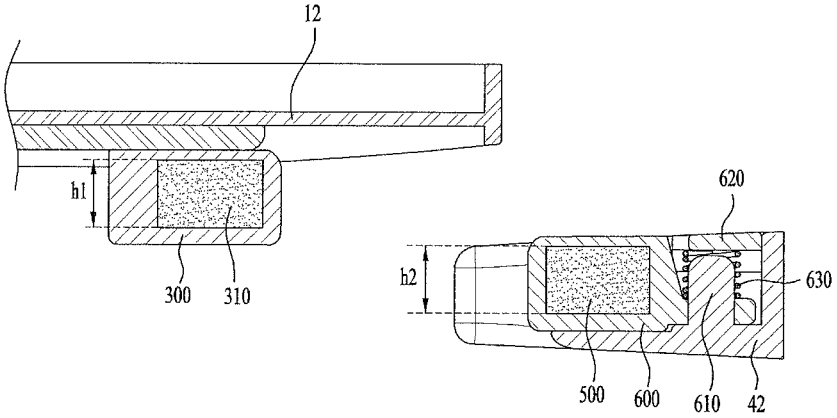
FIG. 12 is a view for explaining an operation according to the embodiment.
Figure 12:
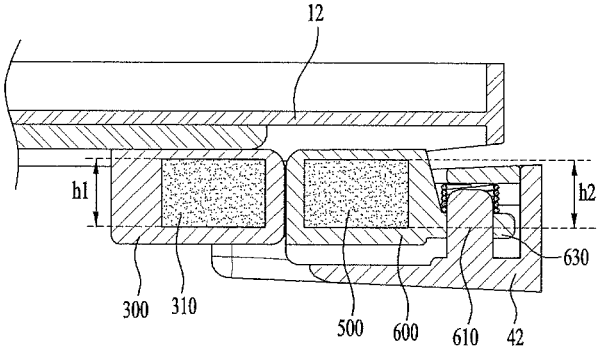

FIG. 12 is a view for explaining an operation according to the present embodiment.

FIG. 12(*a*) illustrates the state in which the second magnet is not located close to the first magnet, i.e. the state in which the second door does not seal the storage compartment. FIG. 12(*b*) illustrates the state in which the second magnet is located close to the first magnet, i.e. the state in which the second door seals the storage compartment, either completely or to at least a predetermined level.

As illustrated in FIG. 12(*a*), the first magnet 310 is installed at a higher position than the second magnet 500. Thus, assuming that the first magnet 310 and the second magnet 500 are fixed, as described in the above embodiment, the second door 40 and the protruding piece 300 may not realize sufficient surface contact therebetween, which is required in order for them to receive force and transfer it to each other. Thus, the protruding piece 300 or the second door 40, more particularly, a related portion of the door dike 42 of the second door 40 may be damaged. Although the size of the protruding piece 300 may be increased to prevent this, this solution may increase the length that the protruding piece 300 protrudes from the inner case 10, thus causing the user to be inconvenienced when using the storage compartment, or to be dissatisfied due to the unpleasing appearance of the storage compartment, which may deteriorate the commercial value. Therefore, in the present embodiment, the problems described above may be solved by reducing the size of the protruding piece 300 to one at which the force of the second door 40 may be stably transferred to the protruding piece 300 or the rotating member 400 so as to drive the pillar 100.

The change from the state of FIG. 12(*a*) to the state of FIG. 12(*b*) means that the extent to which the second door 40 closes the storage compartment is increased or that the operation of the second magnet 500 approaching the first magnet 310 is performed.

When the second magnet 500 approaches the first magnet 310, the second magnet 500 is moved upward toward the first magnet 310. At this time, due to the magnetic attraction between the first magnet 310 and the second magnet 500, the magnetic interference between the first magnet 310 and the second magnet 500 is increased as the distance between the first magnet 310 and the second magnet 500 is reduced, which may cause the second magnet 500 to be moved upward.

Meanwhile, when the second magnet 500 approaches the first magnet 310, the second magnet 500 may be moved so that the center of the second magnet 500 in the height direction is at the same height as the center of the first magnet 310 in the height direction. That is, when the centers of the second magnet 500 and the first magnet 310 in the height direction coincide with each other, the surface contact area between the second door 40 and the protruding piece 300 may be increased, which may enable the second door 40 to stably push the protruding piece 300 so as to operate the rotating member 400.

The length h2 of the second magnet 500 in the height direction may be equal to or less than the length h1 of the first magnet 310 in the height direction. The second magnet 500 may be vertically moved while compressively deforming the elastic member 630, and may be moved by the same distance as the height of the first magnet 310. However, even if the second magnet 500 is moved upward by the same distance as the height of the first magnet 310, it may be necessary to prevent the second magnet 500 from being moved upward and interfering with the inner case 10. Accordingly, in order to prevent the second magnet 500 from being brought into contact with the inner case 10 even if the second magnet 500 is moved upward, the sizes of the first magnet 310 and the second magnet 500 may be adjusted.

In the present embodiment, when a great amount of food is stored in the second door 40, or when the refrigerator is used for a long time, the second door 40 may droop. Because the second magnet 500 may be vertically moved by the moving member, the second door 40 may come into contact with the protruding piece 300 even if the second door 40 droops. For example, when the second door 40 greatly droops, the second magnet 500 may be moved upward by a large distance in order to compensate for the drooping of the second door 40. On the other hand, when the second door 40 slightly droops, the second magnet 500 may be moved upward by a small distance. When the height that the second magnet 500 is moved upward is changed depending on the extent to which the second door 40 droops, the contact area between the second door 40 and the protruding piece 300 may be substantially maintained at a predetermined level or more, which may ensure sufficient surface contact between the second door 40 and the pillar rotation unit 200.

The protruding piece 300 is located so that the upper surface of the protruding piece 300 continuously comes into contact with the ceiling 12 of the inner case 10 because the vertical position of the protruding piece 300 is fixed.

On the other hand, as illustrated in FIG. 12(*b*), the height that the second magnet 500 is moved upward is limited because the maximally compressed state of the elastic member 630 corresponds to the sum of the vertical cross sections of a coil spring. The vertical cross sections of the coil spring may have a circular shape, a rectangular shape, or any other shape.

Even if the second magnet 500 is moved to the maximum extent, the second magnet 500 as well as the case 600 do not come into contact with the ceiling 12 of the inner case 10. Accordingly, even if the user rotates the second door 40, the case 600 does not come into contact with the inner case 10, causing no friction between the inner case 10 and the case 600.

In addition, because the second magnet 500 has a smaller vertical length than the first magnet 310, the upper surfaces of the second magnet 500 and the case 600 do not come into contact with the ceiling 12 even if the vertical center of the second magnet 500 coincides with the vertical center of the first magnet 310. Even when the second magnet 500 is moved upward to the height of the first magnet 310 so as to achieve sufficient contact area for the transfer of force, no friction is generated during the rotation of the second door 40.

Even in the present embodiment, when the second door 40 and the first door 20 are rotated, the operations illustrated in FIGS. 6 and 7 may be performed in the same manner.

While the user rotates the second door 40 so as to open the storage compartment 2, the first magnet 310 is moved forward to follow the second magnet 500. This is because magnetic attraction acts between the first magnet 310 and the second magnet 500 in the state in which the first magnet 310 and the second magnet 500 are close to each other.

In the present embodiment, unlike the above-described embodiment, once the second door 40 has opened the storage compartment 2, the second magnet 500 is moved downward. This is because the magnetic attraction between the first magnet 310 and the second magnet 500 is reduced as the distance between the first magnet 310 and the second magnet 500 is increased, and thus the first magnet 310 may no longer apply force, required to compress the elastic member 630, to the second magnet 500.

Meanwhile, when the second door 40 seals the storage compartment 2, the second magnet 500 is moved upward. The reason for this is that, when the second door 40 approaches the storage compartment 2, the magnetic attraction between the first magnet 310 and the second magnet 500 is increased as the distance between the first magnet 310 and the second magnet 500 is reduced, and thus the first magnet may apply force, required to compress the elastic member 630, to the second magnet 500.

Figure 13:
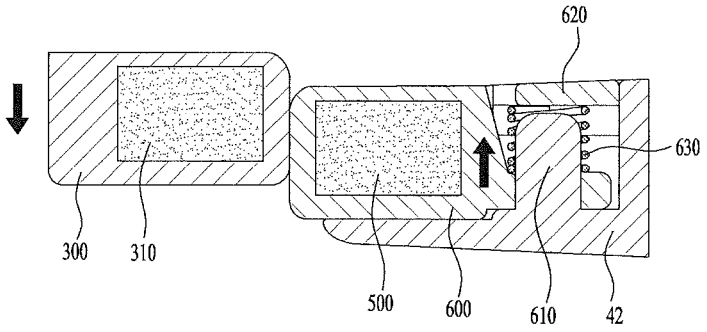
FIG. 13 is a view for explaining an operation according to a further embodiment of the present invention.

FIG. 13 is a view for explaining an operation according to a further embodiment of the present invention.

The present embodiment is a technology in which the two embodiments of the present invention described above are combined. That is, the pillar rotation unit may include the elevating member, and the second door may include the moving member so that both the first magnet and the second magnet may be vertically moved.

That is, when the second door 20 approaches the storage compartment 2 so as to seal the storage compartment 2, the first magnet 310 and the second magnet 500 magnetically attract each other. As such, the first magnet 310 is moved downward and the second magnet 500 is moved upward. At this time, the first magnet 310 and the second magnet 500 may be moved so that the vertical centers thereof coincide with each other.

Specifically, in the present embodiment, the pillar rotation unit 200 may include the housing 210, to which the rotating member 400 is rotatably coupled, and the elevating member 250, which vertically moves the protruding piece 300.

The elevating member 250 may include the guide 252, which is coupled to the two bars 240 provided in the housing 210 so as to guide the longitudinal movement of the elevating member 250, the elastic member 264, which is accommodated in the guide 252, and the guide pin 256, which is vertically moved under the guidance of the elastic member 264. The protruding piece 300 may be coupled to the guide pin 256 so as to be vertically moved together with the guide pin 256. That is, the first magnet 310 may be moved downward depending on the extent to which the elastic member 264 is compressed.

The guide 252 may be provided with the first accommodating recess 254, which has a square shape, and the protruding piece 300 may be provided with the accommodating protrusion 304, which has a square shape and is configured to be inserted into the first accommodating recess 254. The first accommodating recess 254 and the accommodating protrusion 304 may have a gap between facing surfaces thereof so that the protruding piece 300 may be rotated at a predetermined angle relative to the guide 252.

The present embodiment employs both the component that vertically moves the first magnet 310 according to the firstly described embodiment, and the component that vertically moves the second magnet 500 according to the secondly described embodiment. Accordingly, even if the extent to which the second door 40 droops is greater than in the firstly described embodiment and the secondly described embodiment, the contact area between the second door 40 and the protruding piece 300 may be stably secured. This is because the drooping of the second door 40 may be compensated for when the first magnet 310 is moved downward by compressing the elastic member 254 and the second magnet 500 is moved upward by compressing the elastic member 630.

In the present embodiment, when the second door 40 seals the storage compartment 2, the upper surface of the protruding piece 300 is spaced apart from the inner case 10 because the first magnet 310 is moved downward. On the other hand, the second magnet 500 is moved upward by the magnetic attraction between the second magnet 500 and the first magnet 310.

Figure 14:
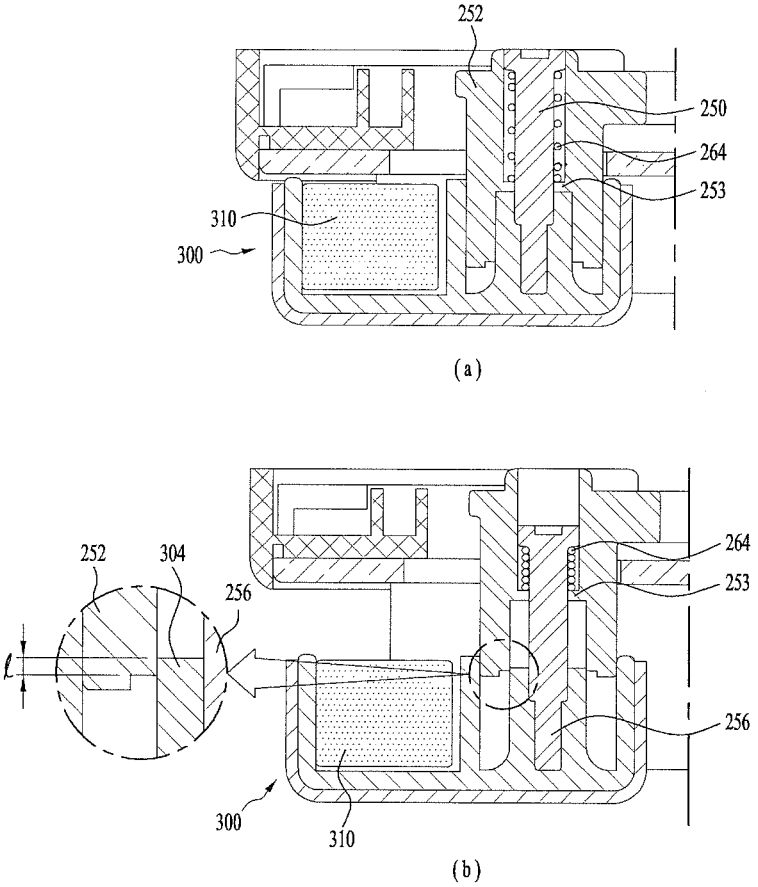
FIGS. 14 and 15 are views for explaining altered major parts of the present invention.
Figure 15:
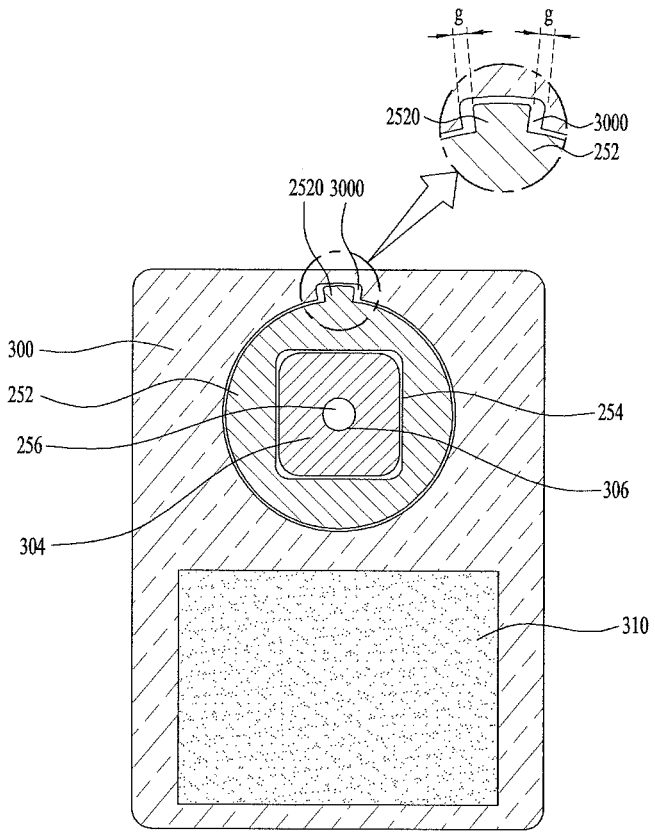

FIGS. 14 and 15 are views for explaining altered major parts of the present invention.

FIG. 14(*a*) illustrates the state in which the protruding piece 300 is not moved downward, and FIG. 14(*b*) illustrates the state in which the protruding piece 300 is moved downward.

In FIG. 14(*b*), unlike FIG. 14(*a*), the protruding piece 300 is moved downward so that the length in the height direction that the accommodating protrusion 304 may come into contact with the guide 252 is reduced to "1". The protruding piece 300 is moved downward when the guide pin 256 is moved downward. Because the accommodating protrusion 304 is integrally formed inside the protruding piece 300, the accommodating protrusion 304 is moved downward along with the protruding piece 300. This is because the protruding piece 300 is coupled to the guide pin 256 via the accommodating protrusion 304.

When the overlapping length in the height direction is reduced to "1" as illustrated in FIG. 14(*b*), the protruding piece 300 may be rotated leftward or rightward beyond a set angle unlike the description of FIG. 8. This is because a reduction in the overlapping length may make it difficult to achieve sufficient force to prevent excessive rotation beyond a set range when the accommodating protrusion 304 is moved in the first accommodating recess 254.

Accordingly, in order to prevent this, as illustrated in FIG. 15, the guide 252 may be provided with a holding protrusion 2520, and the protruding piece 300 may be provided with an accommodating recess 3000 in which the holding protrusion 2520 is accommodated.

The portion of the guide 252 that is coupled to the protruding piece 300 has a circular horizontal cross section. The holding protrusion 2520 extends in the direction in which the radius increases from the center of the guide 252. The holding protrusion 2520 may be formed in a trapezoid shape on the circumferential surface of the guide 252. At this time, the accommodating recess 3000 may have a trapezoid-shaped surface, which faces the trapezoid-shaped holding protrusion 2520.

The two ends of the trapezoid-shaped holding protrusion 2520 may be spaced apart from corresponding ends of the trapezoid-shaped accommodating recess 3000 with a gap therebetween.

The accommodating recess 3000 may be larger than the holding protrusion 2520, whereby the holding protrusion 2520 is rotated in the clockwise direction or in the counter-clockwise direction in the accommodating recess 3000. At this time, the angular rotation range may be set by the gap "g". That is, because the holding protrusion 2520 has the gap "g" with the accommodating recess 3000 at each of the left and right sides thereof, the holding protrusion 2520 may be moved by the gap "g". At this time, the range within which the holding protrusion 2520 may be moved may be the same as the range within which the accommodating protrusion 304 may be moved in the first accommodating recess 254.

The accommodating recess 3000 may accommodate the holding protrusion 2520, thereby limiting the angle at which the protruding piece 300 is rotated.

Accordingly, two factors that limit the range within which the protruding piece 300 may be rotated leftward or rightward are the relationship between the holding protrusion 2520 and the accommodating recess 3000 and the relationship between the accommodating protrusion 304 and the first accommodating recess 254. Accordingly, according to an alternative embodiment of the present invention, it is possible to prevent the twisting of the protruding piece 300, which occurs when the protruding piece 300 is rotated beyond a set range upon application of excessive force to the protruding piece 300.

Figure 16:
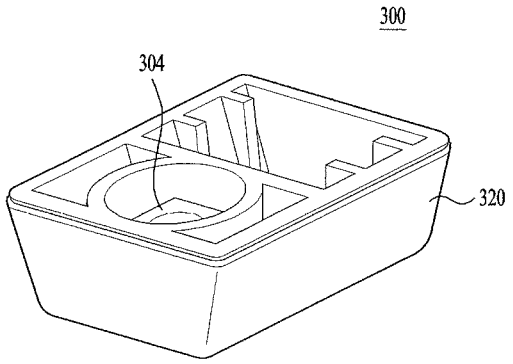
FIG. 16 is a view for explaining differently altered major parts of the present invention.
Figure 16:
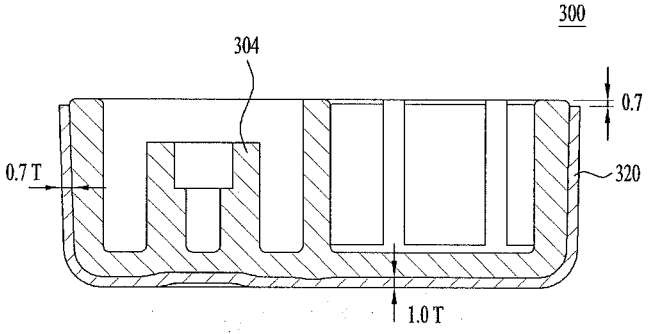

FIG. 16 is a view for explaining differently altered major parts of the present invention.

FIG. 16(*a*) is a top view of the protruding piece, and FIG. 16(*b*) is a side sectional view of the protruding piece.

An elastic material may be formed in the outer circumferential surface of the protruding piece 300, more particularly in the side surface and the lower surface of the protruding piece 300 via insert injection molding. At this time, the elastic material may be a rubber 320. Because the rubber 320 has elasticity, the rubber 320 may absorb shocks applied to the protruding piece 300 when the protruding piece 300 collides with, for example, the door, and may reduce the speed of movement of the protruding piece 300 so as to prevent the protruding piece 300 from being rapidly moved when the protruding piece 300 collides with the door. At this time, the protruding piece 300, which is located in the rubber 320, may be formed of PC and ABS. PC and ABS have a smaller modulus of strain than the rubber 320, thus entailing the possibility of being damaged by small force.

As illustrated in FIG. 16(*b*), the rubber 320 may be formed so that the side surface and the lower surface thereof have different thicknesses. That is, the side surface and the lower surface of the rubber 320 may be differently formed so that the side surface has a thickness of 0.7 T and the lower surface has a thickness of 1.0 T. When the lower surface is thicker than the side surface, the rubber 320 may be easily molded in the protruding piece 300 via insert injection molding. Because the rubber 320 is coupled to the protruding piece 300 via insert injection molding, the rubber 320 may come into close contact with the protruding piece 300 so as to be fixed thereto.

The rubber 320 may be formed to provide the protruding piece 300 with a curved corner portion. Therefore, it is possible to prevent shocks generated when the protruding piece 300 collides with the door from being locally applied to the protruding piece 300.

In addition, the rubber 320 may not be provided on the upper end of the protruding piece 300. That is, when no rubber 320 is provided on the upper end of the protruding piece 300, insert injection molding of the rubber 320 may be easily performed. In addition, this shape of the rubber 320 may simplify a production line. In addition, the upper end of the protruding piece 300 is in contact with the lower housing 230 of the pillar rotation unit 200. Because the rubber 320 is not provided, friction between the lower housing 230 and the protruding piece 300 may not be increased.

Figure 17:
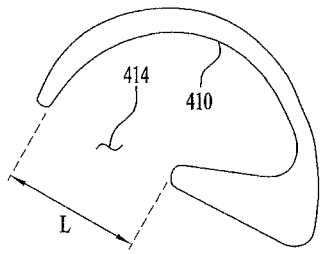
FIG. 17 is a view for explaining an altered embodiment of a guide recess.
Figure 17:
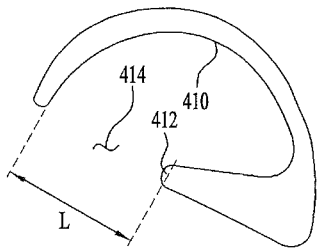

FIG. 17 is a view for explaining an altered embodiment of the guide recess.

FIG. 17(*a*) illustrates an altered form of the guide recess, and FIG. 17(*b*) illustrates a differently altered form of the guide recess. In FIG. 17, for description convenience, other elements of the pillar rotation unit are omitted, and only the shape of the guide recess 410 is illustrated.

In FIG. 17, although the guide recess is altered compared to the guide recess of the pillar rotation unit 200, other parts of the pillar rotation unit 200 may be the same as those of the above description. That is, even in the shape of the guide recess of FIG. 18, as described above, rotation of the pillar may be performed in the same manner as each door is opened or closed.

Unlike FIG. 17(*a*), as illustrated in FIG. 17(*b*), the length of the guide recess may be increased. In FIG. 17(*a*), an opening 414 having a width L may be provided between the two ends of the guide recess 410.

On the other hand, as illustrated in FIG. 17(*b*), the length L of the opening 414 between both ends of the guide recess 410 may be reduced. At this time, in FIG. 17(*b*), an extension 412 may be provided on one end of the opening 414. The extension 412 may block a portion of the opening 414 so as to reduce the width of the opening 414 while the extension 412 may extend a length of the guide recess 410.

The extension 412 may be shaped such that the width of the guide recess 410 increases while the length of the opening 414 in the guide recess 410. That is, the extension 412 may be tapered toward the free end thereof. As such, a portion of the pillar protrusion 110 that comes into contact with the extension 412 may be moved along a longer path, which may ensure the stabilized rotation of the pillar 100.

Figure 18:
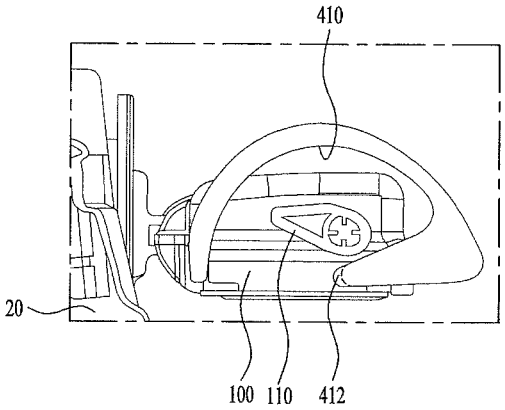
FIGS. 18 and 19 are views for explaining an operation of the pillar along the altered guide recess.
Figure 19:
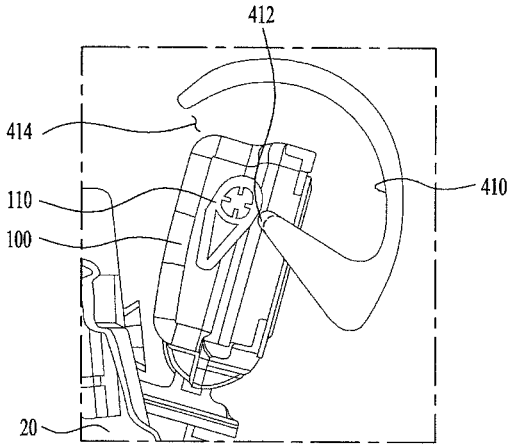

FIGS. 18 and 19 are views for explaining the movement of the pillar along the altered guide recess.

FIG. 18 illustrates the same state as FIG. 7A in which the first door and the second door seal the storage compartment. FIG. 19 illustrates the state in which the first door is located to seal the storage compartment, but the second door is rotated to open the storage compartment. Thus, in FIG. 19, only the rotating member 400 is rotated as illustrated in FIG. 7B or FIG. 7C. In FIGS. 18 and 19, for description convenience, only the guide recess is illustrated, and the rotating member having the guide recess or the pillar rotation unit to which the rotating member is installed are not illustrated.

In FIG. 18, the pillar 100 is not rotated and is in an unfolded state.

In FIG. 19, although not illustrated, the rotating member is rotated as the second door is opened, and thus, the guide recess 410 is rotated.

As the guide recess 410 is rotated, the extension 412 provided at the guide recess 410 may be brought into contact with the pillar protrusion 110, thereby causing the pillar 100 to be rotated and folded. The extension 412 extends to reduce the width of the opening 414 formed in the guide recess 410, which may ensure easy contact between the pillar protrusion 110 and the guide recess 410. Accordingly, when the extension 412 is provided, the portion of the guide recess 410 that is brought into contact with the pillar protrusion 110 may be increased while the guide recess 410 is rotated, and the pillar 100 may be rotated in the counter-clockwise direction at an increased angle. Thereby, when attempting to rotate the pillar 100 to the folded state thereof, the rotation may be performed with enhanced reliability.

Meanwhile, the length of the extension 412 may be set to allow the pillar 100 to rotate by itself using, for example, a spring provided in the pillar 100 after the pillar 100 has reached a certain rotation angle. This rotation angle is referred to as the "dead point" of the pillar 100. The extension 412 having such a length may cause an increased contact area of the pillar protrusion 110 to come into contact with the extension 412, whereby the pillar 100 may be stably rotated to the angle corresponding to the dead point. That is, the dead point may mean the angle to which the pillar 100 may be rotated and folded by itself even if no external force is applied thereto. The extension 412 may have contact area to rotate the pillar 100 to the dead point.

For example, the case where the user pulls out the drawer located near the second door in the state in which the second door is opened and the first door is closed may be considered. When the pillar is not folded in this state, the pulled drawer may be caught by the pillar, which may prevent the drawer from being pulled outward. Therefore, in order to prevent this, in the state in which only the second door is opened, the pillar may be rotated in the counterclockwise direction as illustrated in FIG. 19 so as to improve the reliability of the operation of rotating the pillar 100 in the counterclockwise direction for folding the pillar 100. In order to achieve this reliability, in an alternative embodiment, the extension 412 may be formed to increase the path along which the extension 412 comes into contact with the pillar protrusion 110, which may allow the pillar 100 to be easily folded.

As is apparent from the above description, according to the present invention, in the state in which only a door having a pillar seals a storage compartment and an opposite door opens the storage compartment, the pillar is in the folded state, and therefore does not interfere with a drawer located near the opposite door when the drawer is pulled outward. This may allow a pair of drawers having the same width to be installed at both sides.

In addition, in the state in which only the door having the pillar seals the storage compartment and the opposite door opens the storage compartment, the pillar is in the folded state, and therefore does not interfere with a basket installed on the opposite door when the opposite door is rotated. This may allow the basket to have an angled corner, thus having increased storage capacity.

In addition, according to the present invention, even if a great amount of food is stored in the door and the door droops, stable rotation of the pillar may be ensured.

In addition, according to the present invention, a protruding piece of a pillar rotation unit may be configured so as to be rotated, which may increase the contact area between the protruding piece and the door, resulting in efficient contact between the protruding piece and the door.

In addition, according to the present invention, the rotation angle of the protruding piece may be limited to a predetermined range, which may prevent excessive rotation of the protruding piece.

In addition, according to the present invention, shocks generated when the protruding piece and the door collide with each other may be reduced, which may prevent damage to the protruding piece or the door.

In addition, according to the present invention, the contact area between a pillar protrusion and a guide recess may be increased, which may ensure that the pillar protrusion is stably guided by the guide recess, resulting in enhanced reliability in the folding operation of the pillar.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. A refrigerator comprising:

a cabinet;

an inner case that is located in the cabinet and that defines an interior area;

a first door that is coupled to the cabinet and that is configured to cover a first portion of the interior area;

a second door that is coupled to the cabinet and that is configured to cover a second portion of the interior area;

a pillar that is coupled to the first door and that is configured to rotate between a first position and a second position about a first axis; and a pillar rotation unit that is coupled to the inner case and that is configured to rotate the pillar based on movement of the first door or movement of the second door, the pillar rotation unit including:

a protruding piece that is configured to move based on movement of the second door, an elevating member that is coupled to the protruding piece and that is movable based on movement of the protruding piece, and a rotating member that is coupled to the elevating member and that is configured to rotate based on movement of the elevating member, wherein the pillar is configured to rotate between the first position and the second position based on rotation of the rotating member, wherein the protruding piece is configured to move based on a variable force that varies as a distance between the protruding piece and the second door changes, wherein the protruding piece includes a first magnet and the second door includes a second magnet, and wherein the variable force is a magnetic force between the first magnet and the second magnet.

2. The refrigerator of claim 1, wherein the first magnet is aligned with the second magnet based on a position of the second door.

3. The refrigerator of claim 1, wherein a length of the first magnet in a second axis is equal to or less than a length of the second magnet in the second axis.

4. The refrigerator of claim 1, wherein the pillar rotation unit further includes:

a housing that is coupled to the rotating member and the elevating member.

5. The refrigerator of claim 4, wherein the elevating member includes:

an elastic member that is configured to be compressed or to be stretched, a guide pin that is coupled to the elastic member and that is configured to move based on compression or stretching of the elastic member, and a guide that is coupled to the housing and that is configured to guide the elastic member and the guide pin, wherein the guide pin is coupled to the protruding piece and configured to move with the protruding piece.

6. The refrigerator of claim 5, wherein a recess portion of the guide is inserted into a protruded portion of the protruding piece.

7. The refrigerator of claim 6, wherein the protruded portion of the protruding piece is rotatable within a first angle while being coupled to the recess portion of the guide.

8. The refrigerator of claim 5, wherein a protruded portion of the guide is inserted into a recess portion of the protruding piece.

9. The refrigerator of claim 8, wherein the protruded portion of the guide is rotatable within a second angle while being coupled to the recess portion of the protruding piece.

10. The refrigerator of claim 8, wherein the protruded portion of the guide has a trapezoid shape.

11. The refrigerator of claim 1, wherein the protruding piece includes elastic material that is located on a surface of the protruding piece.

12. The refrigerator of claim 11, wherein the elastic material is rubber.

13. The refrigerator of claim 1, wherein the pillar includes a pillar protrusion that extends from a first side of the pillar, and wherein the rotating member includes a guide portion configured to guide movement of the pillar protrusion.

14. The refrigerator of claim 13, wherein the pillar protrusion is configured to move in the guide portion based on movement of the first door.

15. The refrigerator of claim 13, wherein the guide portion includes a slot or a recess.

16. The refrigerator of claim 13, wherein the guide portion of the rotating member includes an extension that is configured to block rotation of the pillar more than a third angle.

17. The refrigerator of claim 16, wherein the guide portion of the rotating member includes an opening.

18. The refrigerator of claim 17, wherein the extension increases a width of the guide portion and decreases a length of the opening.

* * * * *